US010415306B2

(12) United States Patent
Lin

(10) Patent No.: US 10,415,306 B2
(45) Date of Patent: Sep. 17, 2019

(54) WINDOW COVERING AND STABILITY MECHANISM FOR THE SAME

(71) Applicant: Whole Space Industries LTD, Taipei (TW)

(72) Inventor: Tzu-Yen Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 209 days.

(21) Appl. No.: 15/641,629

(22) Filed: Jul. 5, 2017

(65) Prior Publication Data

US 2019/0010756 A1 Jan. 10, 2019

(51) Int. Cl.

| | |
|---|---|
| ***E06B 9/40*** | (2006.01) |
| ***E06B 9/42*** | (2006.01) |
| ***E06B 9/323*** | (2006.01) |
| ***E06B 9/50*** | (2006.01) |
| ***E06B 9/60*** | (2006.01) |
| ***E06B 9/78*** | (2006.01) |

(52) U.S. Cl.

CPC ..... *E06B 9/42* (2013.01); *E06B 9/323* (2013.01); *E06B 9/50* (2013.01); *E06B 9/60* (2013.01); *E06B 9/78* (2013.01)

(58) Field of Classification Search

CPC ..... E06B 9/42; E06B 9/50; E06B 9/56; E06B 9/60; E06B 9/78; E06B 9/17007

See application file for complete search history.

(56) References Cited

U.S. PATENT DOCUMENTS

| | | | | |
|---|---|---|---|---|
| 13,251 A | | 7/1855 | Bixler | |
| 767,899 A | | 8/1904 | Lanouette | |
| 2,420,301 A | | 5/1947 | Cusumano | |
| 2,498,067 A | | 2/1950 | Chatfield | |
| 3,129,750 A | | 4/1964 | Brandin | |
| 3,854,517 A | * | 12/1974 | Nakamura | E06B 9/46 160/321 |
| 4,221,255 A | | 9/1980 | Barkemeyer | |

(Continued)

FOREIGN PATENT DOCUMENTS

| | | |
|---|---|---|
| DE | 9410216 U1 | 8/1994 |
| EP | 2907963 A1 | 8/2015 |

OTHER PUBLICATIONS

European Search Report for European Patent Application Serial No. 17207278 dated Jun. 6, 2018.

*Primary Examiner* — Beth A Stephan

(74) *Attorney, Agent, or Firm* — Buchanan Ingersoll & Rooney PC

(57) ABSTRACT

A window covering includes a first bracket spaced apart from a second bracket, a shaft positioned between the brackets, and window covering material connected to the shaft. The window covering can also include a window covering material position control mechanism to facilitate positional control for the window covering material. In some embodiments, a rail extends between the first and second brackets above the shaft. Each bracket can include at least one finger that is positionable within a locator hole in an end of the rail so that opposite ends of the rail are connectable to the brackets via the fingers and locator holes. The rail can have a length that is configured so that when the rail is coupled to the first and second brackets via the fingers and locator holes and the brackets can be accurately spaced apart from each other for installation of the window covering.

20 Claims, 8 Drawing Sheets

(56) References Cited

U.S. PATENT DOCUMENTS 4,399,856 A 8/1983 Anderson
4,399,917 A 8/1983 Ohman
4,424,851 A * 1/1984 Kohayakawa ..... E06B 9/68 160/298
4,607,818 A 8/1986 Georgopoulos
4,840,216 A 6/1989 John
5,042,553 A 8/1991 Schaffer et al.
5,105,492 A 4/1992 Karpinski
5,105,871 A 4/1992 Baud et al.
5,167,269 A * 12/1992 Abo ..... E06B 9/90 160/305
5,482,100 A 1/1996 Kuhar
5,667,178 A 9/1997 Yang
5,706,876 A 1/1998 Lysyj
6,024,154 A 2/2000 Wang et al.
6,129,131 A 10/2000 Colson
6,234,236 B1 5/2001 Kuhar
6,283,192 B1 9/2001 Toti
6,289,965 B1 9/2001 Ruggles
6,571,853 B1 6/2003 Ciuca et al.
6,601,635 B2 8/2003 Ciuca et al.
6,601,809 B1 8/2003 Gebrara
6,644,372 B2 11/2003 Judkins
6,644,373 B2 11/2003 Palmer
6,648,050 B1 * 11/2003 Toti ..... E06B 9/322 160/170
6,672,359 B2 1/2004 Morris
6,725,897 B2 4/2004 Palmer
6,761,203 B1 7/2004 Huang
6,817,402 B1 11/2004 Fraczek et al.
6,843,299 B2 1/2005 Judkins
7,021,360 B2 4/2006 Schroder et al.
7,025,107 B2 4/2006 Ciuca
7,108,038 B2 9/2006 Welfonder
7,228,797 B1 6/2007 Hillmann et al.
7,311,133 B2 12/2007 Anderson et al.
7,331,370 B1 2/2008 Militello et al.
7,984,745 B2 7/2011 Wen et al.
8,051,993 B1 11/2011 Tu
8,251,120 B2 8/2012 Chen
8,307,879 B2 11/2012 Lin
8,596,594 B2 12/2013 Shevick
8,887,788 B2 * 11/2014 Toti ..... E06B 9/30 160/170
9,103,157 B2 * 8/2015 Mullet ..... E06B 9/322
9,702,189 B2 * 7/2017 Chen ..... E06B 9/42
9,719,297 B1 * 8/2017 Chen ..... E06B 9/34
2007/0051477 A1 3/2007 Fraser et al.
2007/0056692 A1 3/2007 Nien et al.
2009/0283226 A1 * 11/2009 Cheng ..... E06B 9/60 160/313
2010/0243177 A1 9/2010 Berger
2011/0036516 A1 2/2011 Cheng
2011/0240235 A1 10/2011 Lin
2012/0061037 A1 * 3/2012 Chen ..... E06B 9/42 160/315
2012/0111509 A1 5/2012 Mullet et al.
2013/0098563 A1 * 4/2013 Jang ..... E06B 9/42 160/120
2014/0069595 A1 3/2014 Chen
2014/0157547 A1 * 6/2014 Chen ..... E06B 9/42 16/400
2016/0130863 A1 * 5/2016 Cheng ..... E06B 9/40 160/179

* cited by examiner

WINDOW COVERING AND STABILITY MECHANISM FOR THE SAME

FIELD OF INVENTION

The present innovation relates to window coverings. For example, the present innovation relates to window coverings, mechanisms utilized to help facilitate the installment and positioning of window coverings and mechanisms utilized to help control the position of window covering material adjacent a window.

BACKGROUND OF THE INVENTION

Window coverings can be configured so that a material is moveable to partially or fully cover a window. Examples of window coverings can be appreciated from U.S. Pat. Nos. 8,596,594, 8,307,879, 8,051,993, 7,984,745, 7,331,370, 7,311,133, 7,228,797, 7,108,038, 7,025,107, 7,021,360, 6,843,299, 6,817,402, 6,761,203, 6,725,897, 6,672,359, 6,644,373, 6,644,372, 6,601,809, 6,601,635, 6,571,853, 6,289,965, 6,234,236, 6,283,192, 6,129,131, 6,024,154, 5,706,876, 5,667,178, 5,482,100, 5,105,871, 5,105,492, 5,042,553, 4,840,216, 4,607,818, 4,399,856, 4,399,917, 4,221,255, 3,129,750, 2,498,067, 2,420,301, 767,899, and 13,251 and U.S. Pat. App. Pub. Nos. 2014/0069595, 2012/0111509, 2011/0036516, 2010/0243177, 2009/0283226, 2007/0056692, and 2007/0051477.

Spring motors that may be employed in window coverings can often include spring elements that can add substantial cost to the spring motor unit. For instance, the spring member of the spring motor unit may require use of a substantial transmission system as disclosed in U.S. Pat. No. 6,283,192 or may require use of a type of spring member that has a special construction that can be expensive to help facilitate the support of the variable load of the window covering material as that material is raised or lowered.

Users of window coverings can also have difficulty installing window coverings adjacent a window. For instance, users can have difficulty mounting brackets adjacent a window that are configured to hold a window covering. After installation, users can also be unhappy with the stability of a mounted window covering. Often, this can be due to the fact that the window covering is not properly mounted due to installation error.

SUMMARY OF THE INVENTION

I have determined that a new window covering design is needed that can permit effective height adjustment of window covering material while also permitting a user to more easily and properly install a window covering in a desired position. In some embodiments, the window covering can be configured as a cordless window covering that does not have any exposed operator cord. In other embodiments, the window covering can include exposed lift cords or an exposed operator cord (e.g. a loop cord). A mechanism for the improved stability and ease of installation for a window covering and window covering material position adjustment mechanism, and methods of making and using window coverings and such mechanism are provided herein.

In some embodiments, a window covering includes a shaft having a first end and a second end opposite the first end, window covering material connected to the shaft, a first bracket, a second bracket spaced apart from the first bracket, and a window covering material position control mechanism connected to the first bracket. The window covering material position control mechanism can be configured as a spring motor unit that includes a first spring motor pulley above a second spring motor pulley and a spring extending from the first spring motor pulley to the second spring motor pulley. The second end of the shaft can be connected to the second bracket such that the shaft is rotatable in a first rotational direction for extending the window covering material and is rotatable in a second rotational direction opposite the first rotational direction for retracting the window covering material. The first end of the shaft can be connected to the first spring motor pulley or the second spring motor pulley such that the shaft is rotatable in the first rotational direction and is also rotatable in the second rotational direction and such that the spring biases the shaft to rotate in the second rotational direction for retracting the window covering material.

In some embodiments, the first end of the shaft is connected to the first spring motor pulley. In other embodiments the first end of the shaft is connected to the second spring motor pulley. In yet other embodiments, the window covering material position control mechanism can be configured as a loop cord drive, an electric motor, or other type of control mechanism used for retracting and extending window covering material.

The first spring motor pulley can have a hole and the second spring motor pulley can have a hole. Each hole can receive an axle about which the spring motor pulley is rotatable. A first axle can extend from a body of the first bracket into the hole of the second spring motor pulley. The hole of the first spring motor pulley can be configured to receive a projection extending from the first end of the shaft. For example, a first end shaft connector connected to the first end of the shaft can have a projection that extends into the hole of the first spring motor pulley via a hole in a housing attached to the first bracket that encloses the first and second spring motor pulleys within the first bracket for coupling the first end of the shaft to the first spring motor pulley.

Some embodiments of the window covering can include a second end shaft connector connected to the second end of the shaft. The second end shaft connector can have a projection that extends into an aperture of a rotatable shaft connection mechanism attached to the second bracket for connecting the second end of the shaft to the second bracket. In yet other embodiments, the projection of the second end shaft connector can be rotatably received within an aperture or receptacle defined in a body of the second bracket or a shaft connector attached to the second bracket. In some embodiments, the projection of the second end shaft connector is extendable into and out of a body of the second end shaft connector and/or the projection of the first end shaft connector is extendable into and out of a body of the first end shaft connector. For example, each extendable and retractable projection can be coupled to a body of an end shaft connector such that rotation of a rotatable member attached to that body moves the projection into or out of the body of the connector so that rotation of the rotatable member in one direction (e.g. clockwise or counterclockwise) moves the projection toward a fully retracted position and rotation of the rotatable member in an opposite direction moves the projection toward a fully extended position.

Embodiments of the window covering can also include a rail extending between the first bracket and the second bracket. The rail can be positioned above the shaft. The rail may be an elongated member that is shaped like a bar, beam, rod, or other type of elongated element that has a length. The rail may extend linearly along its length for some embodiments. The rail can have a first end having a first locator hole and a second end opposite the first end of the rail that has a second locator hole. Each locator hole can be configured to receive a finger that may be attached to a top of a bracket.

For example, embodiments of the window covering can include a first resilient finger attached to a top of the first bracket or otherwise structured in the top of the first bracket and a second resilient finger attached to the top of the second bracket or otherwise structured in the top of the second bracket. The first resilient finger can be configured to resiliently move downwardly in response to contact from the rail when the rail is slid along the top of the first bracket and subsequently resiliently moves into the first locator hole when the first locator hole is aligned with the first resilient finger. Similarly, the second resilient finger can be configured to resiliently move downwardly in response to contact from the rail when the rail is slid along the top of the second bracket and subsequently resiliently moves into the second locator hole when the second locator hole is aligned with the second resilient finger.

The first and second brackets and the rail can also be configured to help facilitate locating the first and second resilient fingers into the first and second locator holes. For example, the top of the first bracket can have a profile that defines a first groove and a second groove so that the first resilient finger is positioned between the first groove and the second groove of the top of the first bracket. The top of the second bracket can also have a profile that defines a first groove and a second groove so that the second resilient finger is positioned between the first groove of the top of the second bracket and the second groove of the top of the second bracket. The rail can have a first side and a second side so that the first side of the rail has a profile configured to fit within and slide along the first groove of the top of the first bracket and the first groove of the top of the second bracket and the second side of the rail has a profile configured to fit within and slide along the second groove of the top of the first bracket and the second groove of the top of the second bracket. The first side of the rail can be a front side of the rail and the second side of the rail can be a rear side of the. Each end of the rail may extend between the first and second sides of the rail.

In some other embodiments of the window covering, only the first bracket or only the second bracket may have a finger. For such embodiments, the rail may still have first and second locator holes or may be configured so that only one end of the rail has a locator hole.

Some embodiments of the window covering may have different configurations that may be configured to utilize different types of window covering material position control mechanisms, such as roller spring and clutch arrangements, a cord lock that is coupled to lift cords that are wound about a shaft or pulleys attached to the shaft. Such embodiments may include a first bracket that has a top having a first resilient finger and a second bracket spaced apart from the first bracket that a top having a second resilient finger. A shaft can be positioned between the first bracket and the second bracket so that the shaft is rotatable in a first rotational direction and a second rotational direction that is opposite the first rotational direction. Window covering material can be connected to the shaft so that the window covering material is extendable when the shaft rotates in the first rotational direction and is retractable when the shaft rotates in the second rotational direction. A rail can extend from the first bracket to the second bracket so that the rail is positioned above the shaft. The rail can have a first end having a first locator hole and a second end having a second locator hole. The first resilient finger can be resiliently interlocked within the first locator hole and the second resilient finger can be resiliently interlocked within the second locator hole.

In some embodiments, the first resilient finger is configured to resiliently move downwardly in response to contact from the rail when the rail is slid along the top of the first bracket and subsequently resiliently moves into the first locator hole when the first locator hole is aligned with the first resilient finger and the second resilient finger is configured to resiliently move downwardly in response to contact from the rail when the rail is slid along the top of the second bracket and subsequently resiliently moves into the second locator hole when the second locator hole is aligned with the second resilient finger. The top of the first bracket can have a profile that defines a first groove and a second groove such that the first resilient finger is positioned between the first groove and the second groove of the top of the first bracket. The top of the second bracket can have a profile that defines a first groove and a second groove so that the second resilient finger is positioned between the first groove of the top of the second bracket and the second groove of the top of the second bracket. The rail can have a first side and a second side opposite this first side. The first side of the rail can have a profile configured to fit within and slide along the first groove of the top of the first bracket and the first groove of the top of the second bracket and the second side of the rail can have a profile configured to fit within and slide along the second groove of the top of the first bracket and the second groove of the top of the second bracket.

A method of fabrication and/or installation of an embodiment of a window covering is also provided. For example, an embodiment of installing a window covering can include providing a kit. The kit can include a shaft having a first end and a second end opposite the first end of the shaft, window covering material connected to the shaft, a first bracket that has a top including a first resilient finger, a second bracket having a top including a second resilient finger, and a rail having a first end and a second end opposite the first end of the rail. The first end of the rail has a first locator hole and the second end of the rail has a second locator hole. The method can also include sliding the first end of the rail along the top of the first bracket such that the rail contacts the first resilient finger to resiliently move the first resilient finger downwardly until the first resilient finger is aligned with the first locator hole and resiliently moves into the first locator hole for interlocking with the first end of the rail, sliding the second end of the rail along the top of the second bracket such that the rail contacts the second resilient finger to resiliently move the second resilient finger downwardly until the second resilient finger is aligned with the second locator hole and resiliently moves into the second locator hole for interlocking with the second end of the rail; and mounting the rail, first bracket and second bracket to a structure adjacent a window. The method can also include coupling the shaft to the first and second brackets such that the shaft is positioned between the first and second brackets so that the shaft is rotational in a first rotational direction and a second rotational direction that is opposite the first rotational direction. The window covering material can be extendable when the shaft is rotated in the first rotational direction and the window covering material can be retractable when the shaft is rotated in the second rotational direction.

In other embodiments of the method, the kit can include a window covering material position control mechanism that is connected to or is connectable to the first bracket. The window covering material position control mechanism can be configured as a loop cord drive, an electric motor, a spring motor unit, or other type of control mechanism used for retracting and extending window covering material. The kit can also include a first end shaft connector and a second end shaft connector. Each such connector may be separate from the shaft within the kit or may be provided already attached to the ends of the shaft. The first end shaft connector can have a projection that extends into a hole of a first spring motor pulley or a hole of a pulley of a looped cord drive or hold of a pulley of a motor via a hole in a housing attached to the first bracket that encloses the window covering material position control mechanism. The second end shaft connector can have a projection that extends into an aperture of a rotatable shaft connection mechanism attached to the second bracket for connecting the second end of the shaft to the second bracket. In yet other embodiments, the projection of the second end shaft connector can be rotatably received within an aperture or receptacle defined in a body of the second bracket or a shaft connector attached to the second bracket. The kit can also include instructions that may illustrate and/or utilize text to describe a process by which a customer may interconnect the elements of the kit and use tools and/or fasteners. Such tools and/or fasteners can be provided with the kit or be identified so that a customer may acquire those tools and fasteners separately.

Other details, objects, and advantages of the window covering, window covering positional adjustment mechanism, and methods of making and using the same will become apparent as the following description of certain exemplary embodiments thereof proceeds.

BRIEF DESCRIPTION OF THE DRAWINGS

Exemplary embodiments of the window covering, window covering positional adjustment mechanism, improved stability and installation mechanism, and methods of making the same are shown in the accompanying drawings. It should be understood that like reference numbers used in the drawings may identify like components.

DETAILED DESCRIPTION OF EXEMPLARY EMBODIMENTS

Figure 1:
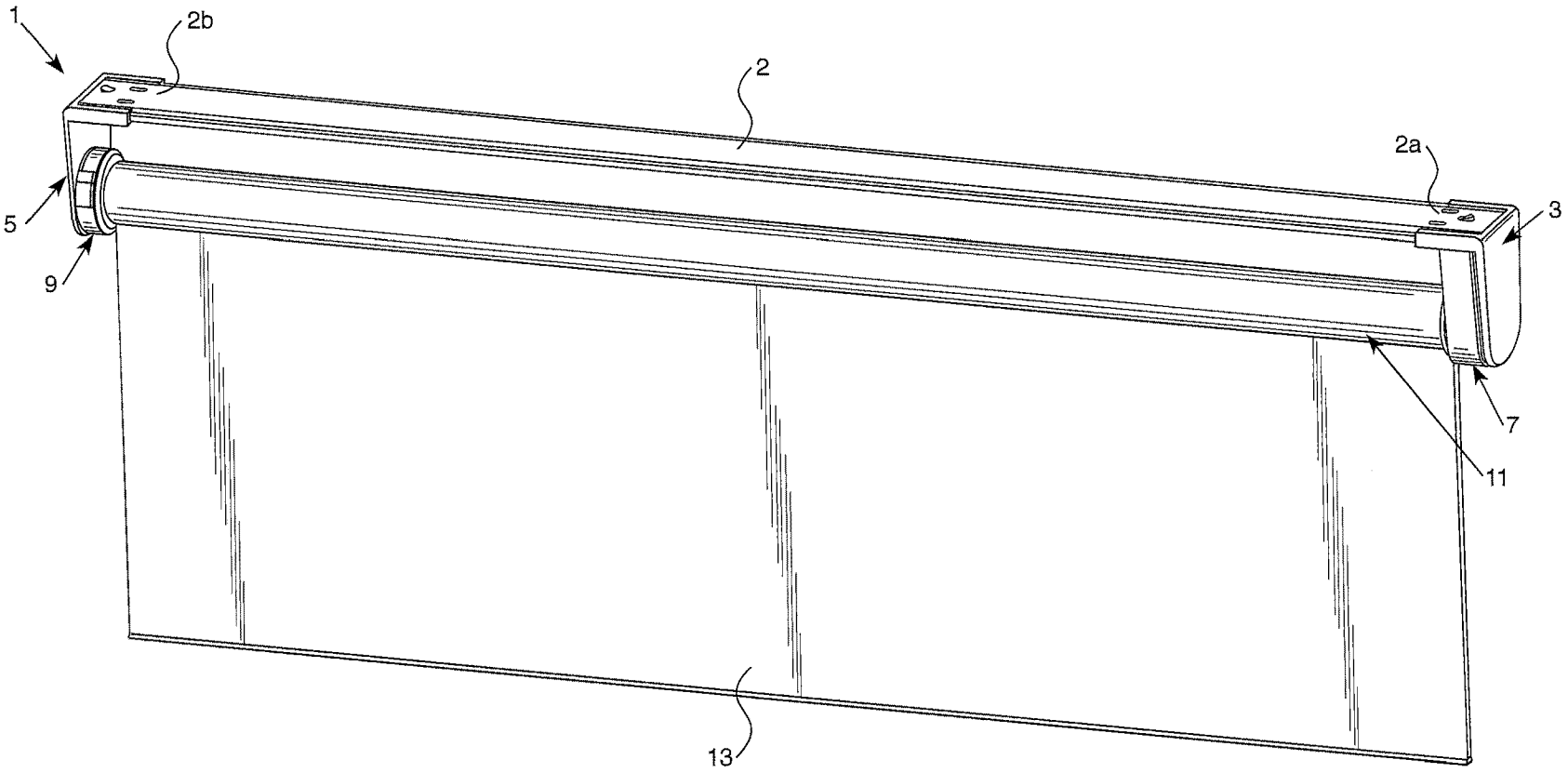
FIG. 1 is a perspective view of a first exemplary embodiment of my window covering.
Figure 2:
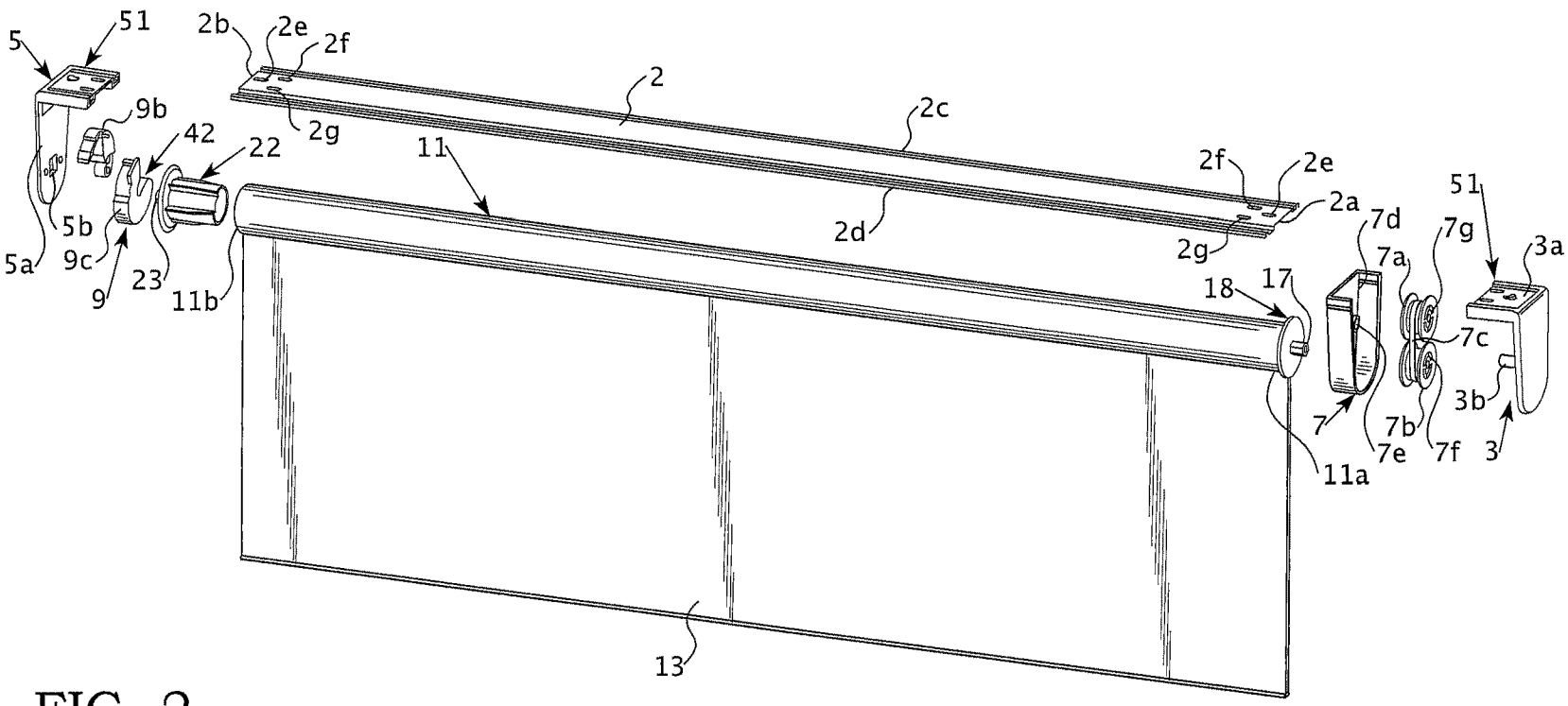
FIG. 2 is an exploded view of the first exemplary embodiment of my window covering.

As can be appreciated from FIGS. 1-12, embodiments of my window covering 1 can include a height adjustment mechanism for controlling the raising and lowering of window covering material. Embodiments of the window covering can be configured to permit the window covering material to be raised and lowered without use of lift cords passing through a cord lock and/or without use of any exposed operator cord. Some embodiments may also be configured so that there is no exposed cord that a child could manipulate (e.g. a loop cord for a loop cord drive, etc.). Other embodiments may include one or more exposed cords, such as exposed lift cords or exposed venetian blind slat ladder cords or exposed venetian blind ladder tape.

Embodiments of the window covering 1 can include a first rail 2 that extends from the top of a first bracket 2 to the top of a second bracket 5 above the shaft 11 and window covering material 13. The first bracket 3 can be attached to a window covering material position control mechanism 7 that is connected to a first end 11*a* of a rotatable shaft 11 for connection of the rotatable shaft 11 to the first bracket 3. The second bracket 5 can be connected to a second end 11*b* of the rotatable shaft 11 that is opposite the first end of the rotatable shaft 11. A rotatable shaft connection mechanism 9 can be attached to the second bracket for coupling the second end 11*b* of the rotatable shaft 11 to the second bracket 5.

The rotatable shaft can be a roller, a bar, a rod, an elongated member, a tube, a cylinder, or other type of shaft. Window covering material 13 can be wound upon on the shaft 11 so that the window covering 1 is configured as a roller shade type of window covering. Rotation of the shaft in a first direction may wind the window covering material on the shaft 11 for raising the position of the window covering material 13 and rotation of the shaft in a second direction can unwind the window covering material from the shaft for lowering of the window covering material to a lowered position. In some embodiment, the first rotational direction may be clockwise and the second rotational direction may be counterclockwise. In other embodiments, the first rotational direction can be counterclockwise and the second rotational direction can be clockwise.

In other embodiments, it is contemplated that the window covering material 13 can be coupled to lift cords that are wound and unwound from the rotatable shaft For such embodiments, the window covering material can be raised or lowered via the winding and unwinding of the lift cords about the shaft. The lift cords may be wound directly on the shaft and unwound directly from the shaft 11 or may be received within one or more pulleys that may rotate via rotation of the shaft for the unwinding and winding of the lift cords from the shaft 11. Such embodiments can be configured as a Roman shade, pleated shade, or other type of window covering.

The window covering material position control mechanism 7 can include a spring motor unit that is retained within a housing 7*d* coupled to the body 3*a* of the first bracket 3. The window covering material position control mechanism can include a first spring motor pulley 7*a*, a second spring motor pulley 7*b* and a spring 7*c* that extends from the first spring motor pulley 7*a* to the second spring motor pulley 7*b*. The spring 7*c* can include a spring member that is configured to wind upon one of the spring motor pulleys during raising of the window covering material and is to unwind from that pulley and wind about the other spring motor pulley when the window covering material is lowered. The spring 7*c* can be configured to retain the position of the window covering material 13 at a user selected position when a user removes a force for lowering of the window covering material. The spring 7*c* can be configured to wind about one of the spring motor pulleys to drive rotation of the shaft 11 for winding up the window covering material about the shaft or otherwise raising the window covering material in response to a user providing an upward force on the window covering material.

For example, the first spring motor pulley 7*a* can be positioned above the second spring motor pulley 7*b* and can have a central hole that receives a projection 17 extending from a first end shaft connector 18 that extends through a hole 7*e* in a housing 7*d* attached to the first bracket. The length of this projection 17 can be any length that may be desired for ensuring the projection can extend from adjacent the first end 11*a* of the shaft 11 for attachment to the window covering material position control mechanism 7.

The first end shaft connector 18 is coupled to the first end of the shaft 11 such that rotation of the spring motor pulley 7*a* causes the shaft 11 to rotate (e.g. rotation of the first spring motor pulley 7*a* in the first rotational direction causes the shaft 11 to rotate in the first rotational direction and rotation of the first spring motor pulley 7*a* in the second rotational direction causes the shaft 11 to rotation in the second rotational direction). The second spring motor pulley 7*b* can have a central hole that receives a projection 3*b* extending from the body 3*a* of the first bracket 3 such that the second spring motor pulley 7*b* is rotatable about the axis defined by this projection 3*b* in opposite directions. When a user grabs the window covering material 13 to unwind the material from the shaft 11 for lowering the window covering material 13, the first and second spring motor pulleys may rotate in first rotational directions such that the spring unwinds from one of those pulleys and winds about the other of the pulleys for providing a biasing force on the spring motor pulleys to prevent the first spring motor pulley 7*a* from rotation after a user releases the window covering material 13 so that the user-selected position of the window covering material is maintained at that user selected position. Thereafter, a user may provide an upward force on the window covering material 13 to actuate the raising of the window covering material. In response to that upward force, the spring 7*c* may unwind from one of the spring motor pulleys and wind about the other of the spring motor pulleys to cause the first spring motor pulley 7*a* to rotate to drive rotation of the shaft 11 so that the window covering material is wound upon the rotating shaft for raising of the window covering material. The user may stop providing the upward force after the window covering material is at a new user-desired position (or is fully raised such that the window covering material is fully wound upon the shaft) such that the spring stops its movement and acts to bias the spring motor pulleys for retaining the position of the window covering material at the new position.

The second end of the shaft 11 can be connected to the second bracket 5 via a second end shaft connector 22 that is connected to the second end 11*b* of the shaft 11 for coupling the second end 11*b* of the shaft 11 to the second bracket 5. The second end shaft connector 22 can include a projection 23 that extends into an aperture 42 for rotatably receiving the projection 23 so that the shaft is rotatable in opposite directions. The length of this projection 23 can be any length as desired to help facilitate a connection between the second end 11*b* of the shaft 11 and the second bracket 5. The aperture 42 may be defined in a bracket connector (e.g. a receptacle attached to or defined in the bracket, etc.) that is attached to the second bracket 5 for attachment of the second end 11*b* of the shaft 11 to the second bracket 5. In some embodiments, the aperture 42 is configured so that the projection 23 can pass through that aperture 42 and into an opening 5*b* defined in a body 5*a* of the second bracket 5. That opening 5*b* can be configured as a hole, a slot, a slit, or other type of opening that is aligned with the aperture 42 for receiving a distal end of the projection 23 of the second end shaft connector 22.

Figure 10:
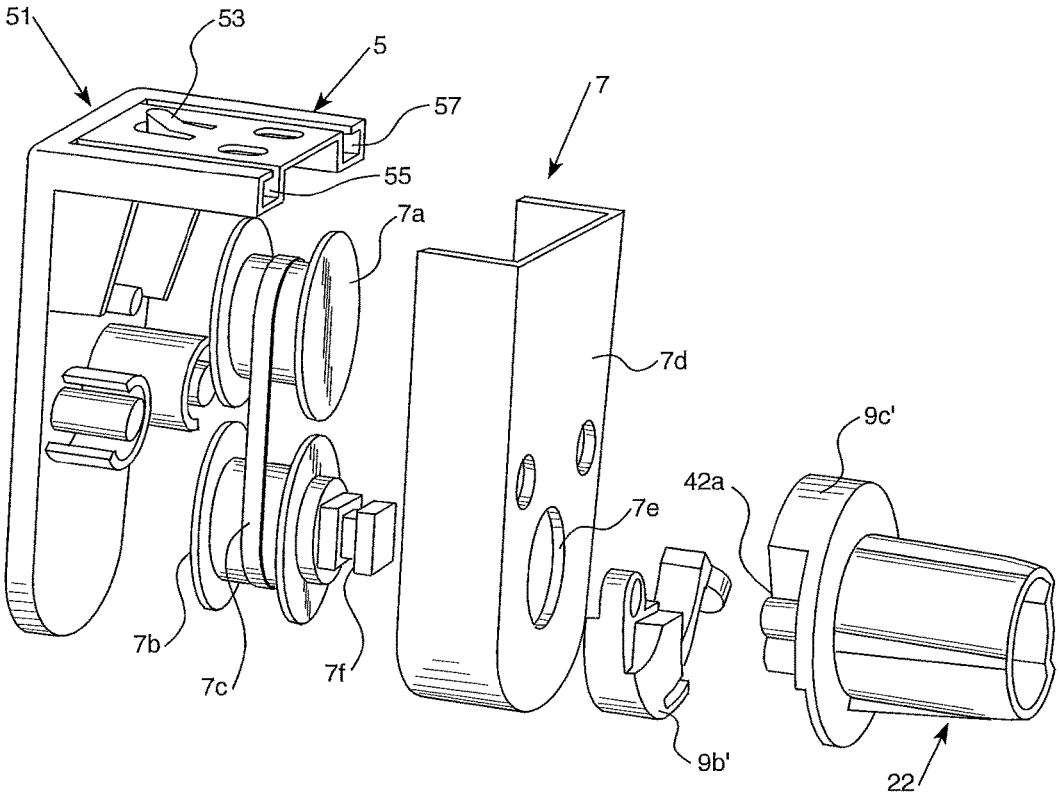
FIG. 10 is an exploded fragmentary view of an exemplary embodiment of a second bracket 5 being coupled to a window covering material position control mechanism configured for attachment to a second end of a rotatable shaft 11 that may be used in embodiments of the window covering.

In other embodiments, (as may be appreciated, for example, from the embodiment shown in FIG. 10), the second bracket 5 can be coupled to a window covering material position control mechanism 7 for coupling to the second end 11*b* of the shaft 11. The use of a second window covering material position control mechanism 7 connected to the second bracket 5 can be helpful in providing a supplemental force for maintaining a position of the window covering material and facilitating the raising of the window covering material 13 for assisting the first window covering material position control mechanism 7 connected to the first bracket 3 if the window covering material 13 is particularly heavy (e.g. the length of the material is very long and/or the window covering material is composed of a relatively heavy material).

Figure 3:
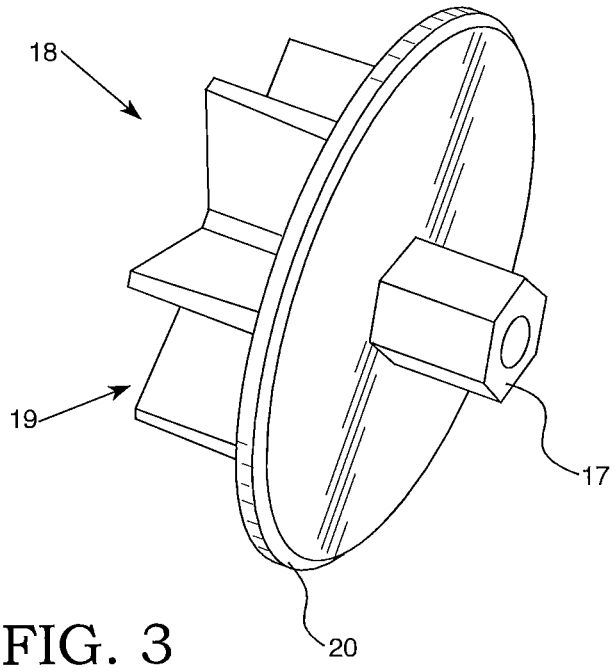
FIG. 3 is a perspective view of an exemplary first end connector for a first end of a tube or shaft element of the first exemplary embodiment of my window covering.

Referring to FIG. 3, the first end shaft connector 18 can include a body that has the projection 17 that extends away from an end cap 20 that is sized to be positioned at a distal end of the shaft 11 to extend around a circumference or perimeter of the end of the shaft to define a sidewall or end wall for retention of window covering material 13 on the shaft 11. The projection 17 can be extendable and retractable. A shaft connection body 19 can extend from the end cap 20 in a direction that is opposite the projection 17 for extending into a channel of the shaft 11 for attachment of the first end shaft connector 18 to the first end 11*a* of the shaft 11. The shaft connection body 19 can have a particular configuration for mating with the shape of the channel or other type of opening defined in the first end of the shaft 11 to provide an interlocking connection of the first end shaft connector 18 to the first end 11*a* of the shaft 11 within the shaft 11.

Figure 4:
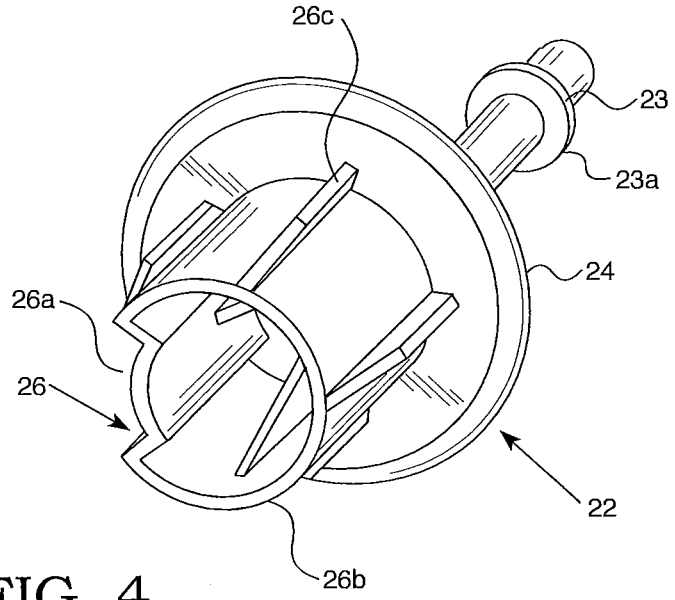
FIG. 4 is a perspective view of an exemplary second end connector for a second end of a tube or shaft element of the first exemplary embodiment of my window covering.

Referring to FIG. 4, the second end shaft connector 22 can include a body that has an end cap 24 that is sized to be positioned at a distal end of the shaft 11 to extend around a circumference, or perimeter, of the shaft adjacent the second end 11*b* of the shaft 11 to define a sidewall or end wall for retaining the window covering material 13 on the shaft 11 between its first and second ends 11*a* and 11*b*. The projection 23 of the second end shaft connector can extend away from the end cap 24 and a shaft connection body 26 can extend away from that projection 23 and the end cap 24 within the second end 11*b* of the shaft 11. The projection 23 can be retractable and extendable.

The shaft connection body 26 can include a profile for interlocking with an opening at the second end 11*b* of the shaft for providing an interlocking connection with the second end 11*b* of the shaft. The profile of the shaft connection body can include a plurality of fins 26*c* attached to a member 26*b* of the shaft connection body 26 and one or more grooves 26*a* defined in the member 26*b* of the shaft connection body 26.

Figure 5:
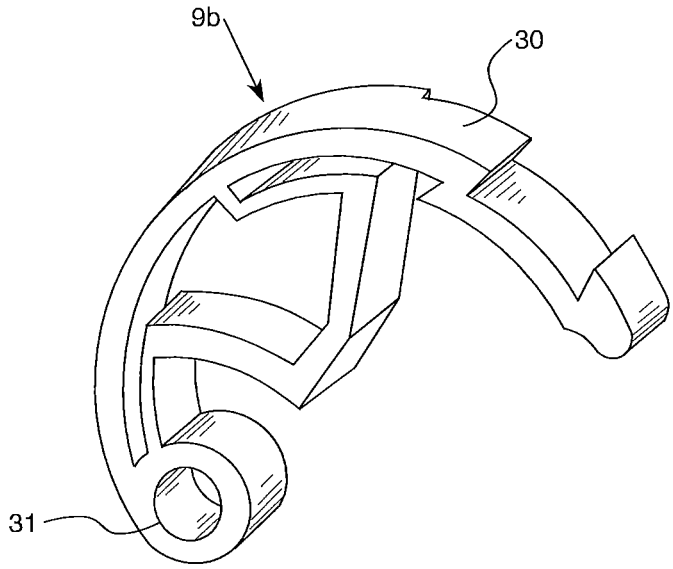
FIG. 5 is a perspective view of a first element of an end connection mechanism of the first exemplary embodiment of my window covering shown in FIG. 2.
Figure 6:
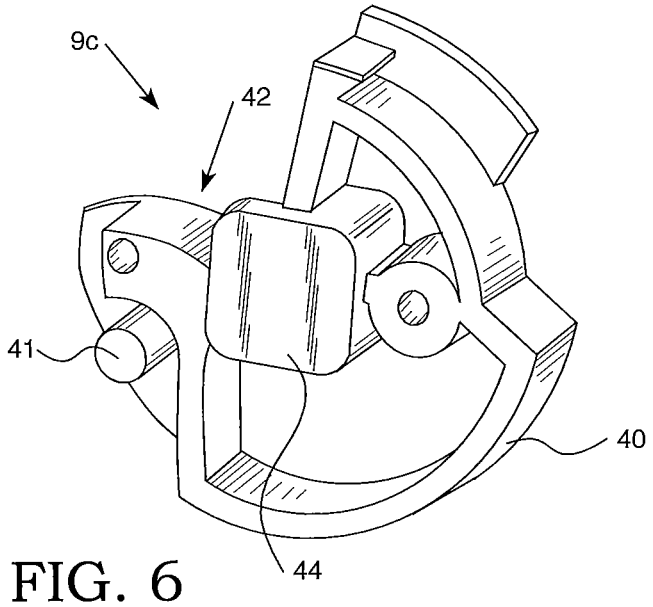
FIG. 6 is a perspective view of a second element of an end connection mechanism of the first exemplary embodiment of my window covering shown in FIG. 2.

Referring to FIGS. 5 and 6, the rotatable shaft connection mechanism 9 positioned between the second bracket 5 and the second end 11*b* of the shaft 11 can be configured to include a protuberance 44 that is received within the opening 5*b* of the body 5*a* of the second bracket 5. A body 40 attached to the protuberance may include a pin 41 that is configured to extend within a hole 31 of the body 30 of a second part 9*b* of the rotatable shaft connection mechanism 9. The second part 9*b* can be configured to move relative to the first part 9*c* via the pin 41 within the hole 31 so that the connector can be moved to a first position (e.g. an unlocked position) for receiving the projection 23 within aperture 42 and then moved to a second position for retaining that projection 23 within the aperture (e.g. a locked position). The body 30 of the second part can have other configured shapes or elements for mating with corresponding structure defined in the body of the first part as to facilitate the locking and unlocking of the projection 23 within the aperture 42 and/or attachment of the second end 11*b* of the shaft 11 to the body 5*a* of the second bracket 5. The projection 23 can also include a washer-type element 23*a* that may be positioned in a middle portion of the projection 23 to help ensure the projection 23 stays retained within the aperture 42. This washer-type element 23*a* may be a washer, a circumferential or perimeter rib defined on the projection, or may be a portion of the projection that has a greater width or circumference than the elongated segment of the projection so that the wider/thicker section or washer-type element is able to engage a part of the rotatable shaft connection mechanism 9 adjacent the aperture 42 to help prevent the shaft 11 from becoming dislodged or decoupled from the second bracket 5 after the projection 23 is positioned within the aperture 42 and/or the second part 9*b* is moved into its locked position for retention of the projection 23 within aperture 42.

As shown in FIGS. 5 and 6, the rotatable shaft connection mechanism 9 can include a first part 9*c* that is attached to a second part 9*b* to define the mechanism. In other embodiments, the mechanism may be a unitary structure or another type of interconnected structure.

Referring to FIG. 10, the optional second window covering material position control mechanism 7 that can be coupled to the second bracket 5 is shown along with an alternative embodiment of a second end shaft connector 22 that can be utilized for attachment of the second end 11*b* of the shaft 11 to the second window covering material position control mechanism 7 attached to the second bracket 5. The second window covering material position control mechanism 7 can include a first spring motor pulley 7*a* that is positioned above a second spring motor pulley 7*b*. A spring member 7*c* can extend form the first spring motor pulley 7*a* to the second spring motor pulley 7*b* and be moveable between these pulleys to account for movement of window covering material as discussed herein. The spring motor pulleys have central holes that receive posts or projections extending from the body of the second bracket to define axles about which each pulley is rotatable. A housing 7*d* can be connected to the body of the second bracket 5 for enclosing the spring motor pulleys and spring member. The housing 7*d* can include a hole 7*e* that is sized to permit a projection to pass through that hole for facilitating connection between the first spring motor pulley 7*a* and the second end 11*b* of the shaft or for facilitating a connection between the second spring motor pulley 7*b* and the second end of the shaft 11*b*. The projection may be a projection 23 of a second end shaft connector 22 such that the second window covering material position control would be connectable to the second end 11*b* of the shaft 11 similarly to how the first window covering material position control is shown as being connected to the first end 11*a* of the shaft 11 in FIGS. 1 and 2.

The projection could alternatively be a projection 7*f* that extends from a spring motor pulley for passing through hole 7*e* and being received within an aperture defined in a body of the second end shaft connector 22. For embodiments in which the projection 7*f* extends from a spring motor pulley, the body of the second end shaft connector 22 can be defined to include a projection receiving aperture 42*a* that is defined by a first part 9*c*' that is integral to a distal body portion of the second end shaft connector 22 and a moveable second part 9*b*' that is rotatably connected to the first part 9*c*' for movement between open and closed positions. In some embodiments, the second part 9*b*' can be shaped similar to second part 9*b* of the rotatable shaft connection mechanism 9 and the first part 9*c*' can be shaped similarly to the first part 9*c* of the rotatable shaft connection mechanism 9. In other embodiments, these parts may have a different shape, size, and configuration.

The moveable second part 9*b*' can be moveable to an open position so that the projection 7*f* can be passed into the aperture 42*a* and subsequently moved to a closed position to retain the distal end of the projection 7*f* within the aperture 42*a* for coupling the second window covering material position control mechanism 7 to the second end 11*b* of the shaft 11. This coupling can permit the spring 7*c* of the second window covering material position control mechanism 7 to bias motion of the shaft 11 to complement the force provided by the spring of the first window covering material position control mechanism 7 connected to the first end 11*a* of the shaft 11.

It should be appreciated that embodiments of the first window covering material position control mechanism 7 coupled to the first bracket 3 may alternatively be configured to have a projection 7*f* extending from a spring motor pulley or other drive pulley (e.g. pulley of a loop cord drive) and that the first end shaft connector 18 can be configured to define an aperture for receiving that projection.

Figure 11:
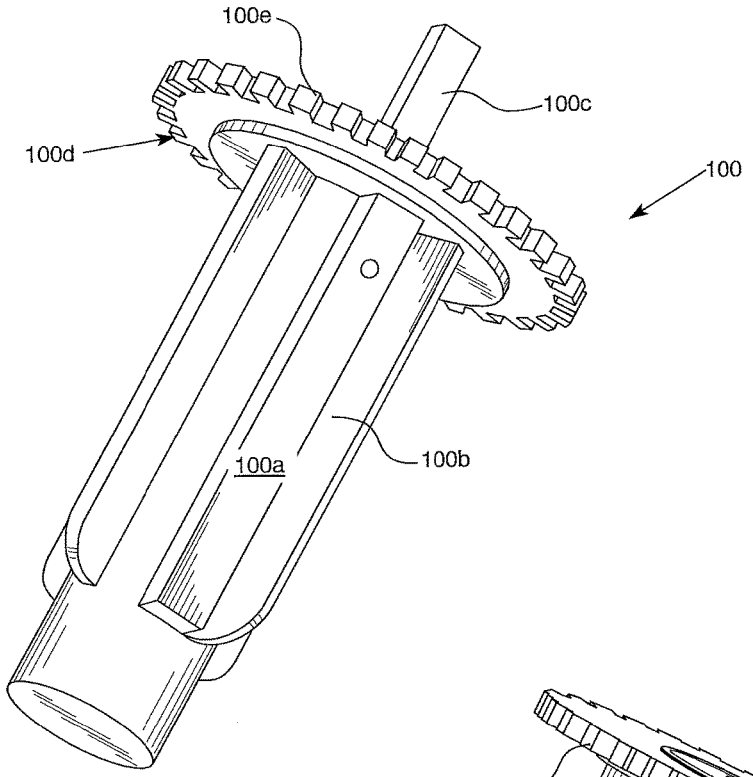
FIG. 11 is a perspective view of an exemplary embodiment of a rotatable shaft end connector that can be attached to the first end 11*a* or the second end 11*b* of a rotatable shaft 11 in embodiments of the window covering illustrating the connector in a first position in which a projection extends from a body of the connector. It should be understood that embodiments of this rotatable shaft end connector can be included in embodiments of a kit for the making and/or installation of the window covering as well.
Figure 12:
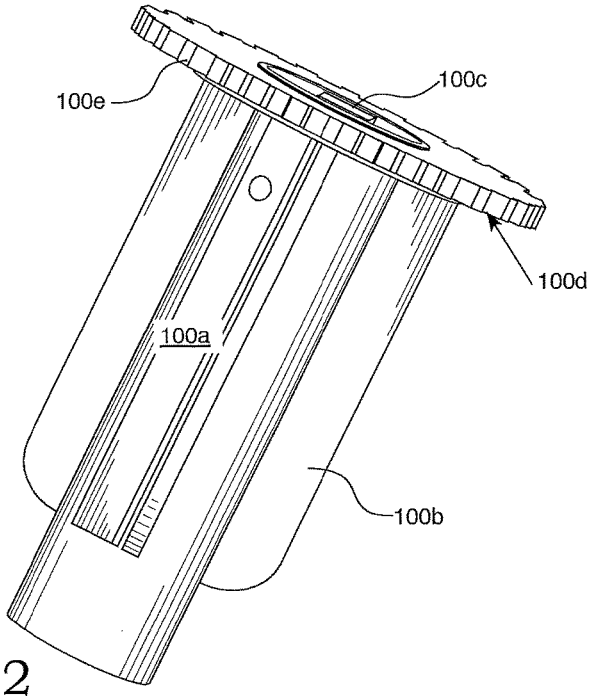
FIG. 12 is a perspective view of the exemplary embodiment of the rotatable shaft end connector illustrated in FIG. 11 illustrating the connector in a second position in which a projection is fully retracted within a body of the connector.

Referring to FIGS. 11 and 12, the connectors utilized for connecting the first and second ends 11*a* and 11*b* of the shaft 11 to first and second brackets 3 and 5 can have other shapes or configurations. Each shaft 11 end connector can be configured as a shaft end connector 100 as shown in FIGS. 11-12 or only one end of shaft 11 could have such a connector and the other end may have a different connector attached thereto for coupling to a bracket. For instance, the second end shaft connector 22 and the first end shaft connector 18 can each be configured as a shaft end connector 100 or only one of these connectors can be configured as a shaft end connector 100.

The shaft end connector 100 can include a body 100*a* that has a plurality of ribs 100*b* that extend from the body to define grooves between immediately adjacent ribs 100*b*. A distal end of the body can have an enlarged rotatable member 100*d* attached to the distal end of the body 100*a* so that the member can be positioned at a distal end of the shaft 11 and be sized to extend beyond the outer periphery of the shaft 11 to function as an endwall for helping to retain window covering material 13 on the shaft and retain that material on the shaft as it is wound about the shaft during retraction of the window covering material 13 and to help retain the material on the shaft as it is moved during extension of the window covering material 13. The rotatable member 110*d* can be shaped as a circular member, be shaped as a plate or have another type of shape or orientation (e.g. be an oval in shape, be polygonal in shape, etc.). The rotatable member 100*d* can have teeth 100*e* defined thereon or attached to a peripheral edge of the member. The teeth 100*e* can be configured to help a user grip the member to rotate the member 100*d* in opposite rotational directions. The rotatable member 100*d* can be connected to a distal end of the body 100*a* so that a user must provide at least a pre-specified or pre-determined amount of force to effect rotation of the rotatable member 100*d* in either direction via the connection defined or formed between the rotatable member 100*d* and the body 100*a*.

A retractable and extendable projection 100*c* can be attached to the body 100*a* so that the projection 100*c* is extendable from the body 100*a* and is also retractable within the body 100*a*. The projection 100*c* can be retractable such that the entirety of the projection 100*c* is positioned within the body 100*a* and rotatable member 100*d* when the projection 100*c* is moved to a first fully retracted position. When the projection 100*c* is moved to a fully extended position, a distal end of that first projection and a portion of the middle portion of the projection 100*c* can extend out of the body and be external to the body 100*a* and rotatable member 100*d* such that a portion of the projection 100*c* extends a length away from the rotatable member and away from the end of the shaft 11 to which the connector 100 is attached. The projection 100*c* can have a cross-sectional shape and sized configured to pass through a hole 7*e* in a housing 7*d* for engagement with a spring motor pulley or other pulley or for attachment to a portion of a bracket and/or window covering material position control mechanism attached to a bracket. The projection 100*c* can also (or alternatively) be shaped and sized for attachment to a connector attached to the bracket to facilitate attachment of the end of the shaft 11 to a bracket by being received within a receptacle of the bracket or bracket connector.

Figure 7:
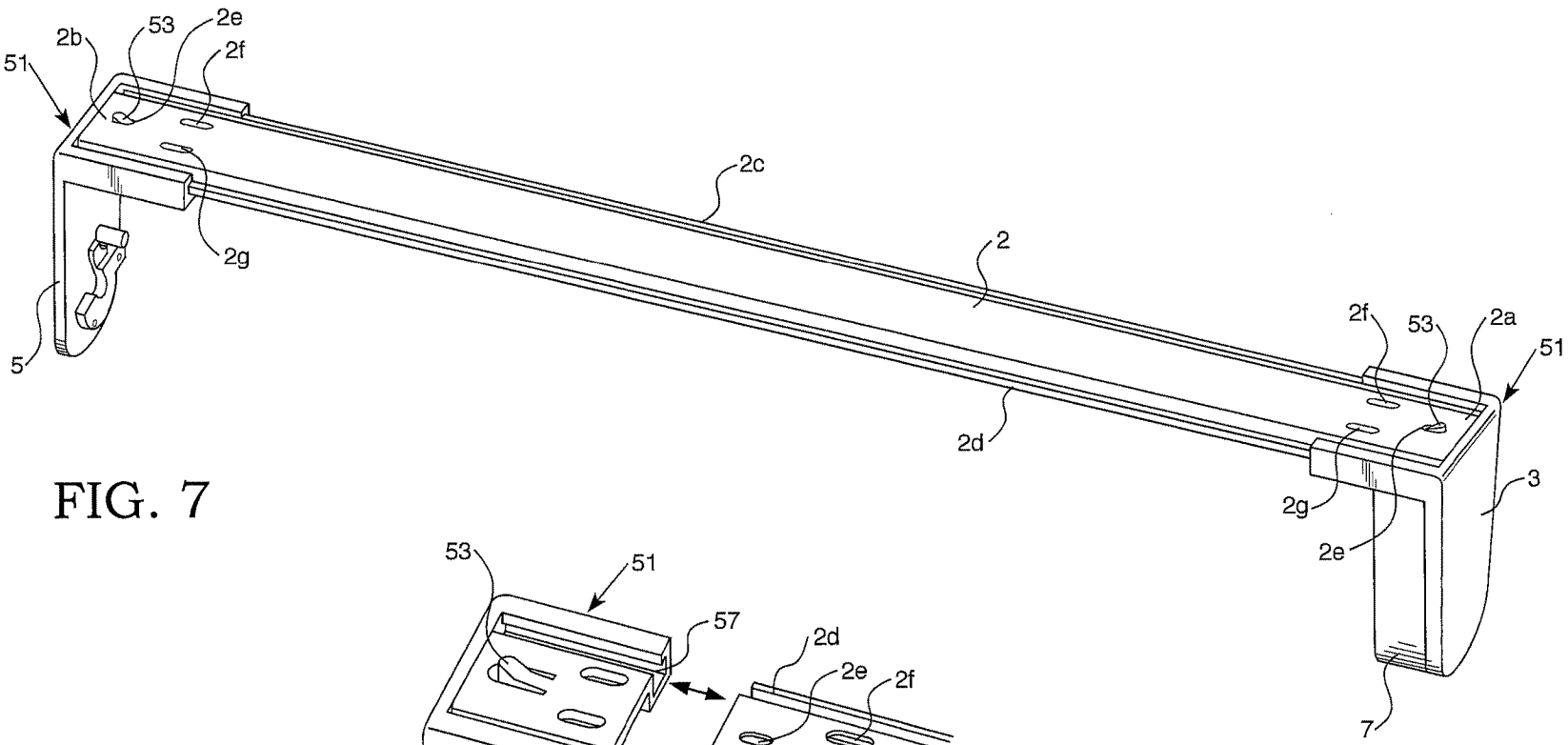
FIG. 7 is an enlarged fragmentary view of the first exemplary embodiment of my window covering illustrating a rail extending between first and second brackets.
Figure 8:
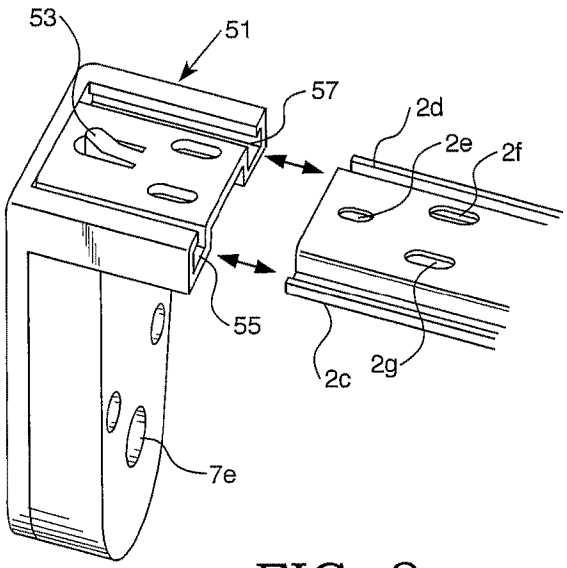
FIG. 8 is a fragmentary view of the first exemplary embodiment of my window covering illustrating how the ends of the rail are locatable and connectable to the tops of the first and second brackets via resilient locking members.

Referring to FIGS. 7 and 8, the ends of the rail 2 can be coupled to the tops of the first and second brackets 3 and 5 for mounting of the window covering 1 adjacent a window via fasteners passing through the rail 2. In other embodiments, the rail 2 may not be present such that mounting of the first and second brackets 3 and 5 adjacent opposite sides of a window frame via fasteners or fastening mechanisms may be needed for mounting of the window covering 1. When the rail 2 is present, the rail 2 can help provide increased stability to a mounted window covering and also provide for an alternative way in which the window covering can be mounted as the rail 2 can facilitate mounting instead of the brackets or in combination with the brackets.

The rail 2 can include a first end 2*a* and a second end 2*b* opposite its first end. Each end may have the same profile for facilitating attachment to the first and second brackets 3 and 5. Each of the first and second brackets 3 and 5 may also have a similar (or the same) structure defined in the top of the bodies 3*a* and 5*a* of the brackets to facilitate attachment to either end of the rail 2. FIG. 8 illustrates an exemplary embodiment of how each end (e.g. both the first end 2*a* and the second end 2*b*) can be attached to a respective one of the first and second brackets 3 and 5 via the top profile 51 defined in the body of that bracket and at least one resilient finger 53 defined in the top profile that is configured to help locate an end of the rail and attach the end of the rail to the top of the bracket.

As may be seen from at least FIGS. 7-8, the first and second brackets 3 and 5 each include a body that has a top portion defining a top profile 51. This profile 51 includes a first groove 55 adjacent a first side of the top profile 51 and a second groove 57 adjacent a second side of the top profile 51 that is opposite the first side. At least one resilient finger can be defined in the top profile 51 or be attached to the top of the bracket 51 between the first and second grooves 55 and 57. There may also be holes defined in the top profile that are sized to receive fasteners for aligning with holes 2*f* and 2*g* in an end of the rail 2 to facilitate the insertion of fasteners through those aligned holes for mounting of the bracket and rail to a window frame or to some other structure adjacent a window.

The first groove 55 can be configured to receive a first side 2*c* of the rail that may be configured to have a groove or other profile that is to slideably mate with the shape of the first groove 55 and the second groove 57 can be configured to receive a second side 2*d* of the rail 2 that is opposite its first side 2*c* of the rail so that the second side 2*d* of the rail slideably mates with the second groove 57. The top profile 51 of the bracket can be shaped and otherwise configured so that the first and second sides 2*c* and 2*d* of the rail adjacent an end of the rail is slideably receivable within the first and second grooves so that a middle portion between the first and second sides 2*c* and 2*d* passes over a top portion of the body of the bracket. The end of the rail 2 (e.g. the first end 2*a* or second end 2*b*) can be locked into position on the top profile 51 of the bracket when at least one locating hole 2*e* is passed over a corresponding at least one resilient finger 53. Each resilient finger 53 can be configured so that it resiliently flexes, bends, or otherwise moves downward in response to a middle portion of the body of the rail contacting the finger as the rail is slid over the top of the profile 51 and over the finger 53 and, in response to the locating hole 2*e* define in the rail 2 passing over the finger 53, the finger 52 can then be biased to move upwardly into the hole 53 immediately upon that hole 2*e* being aligned with a portion of the finger such that a distal upper part of the finger 53 can extend through the locating 2*e* hole to interlock with the rail 2 within the locating hole 2*e* for locating the rail 2 on the top profile 51 of the bracket and for attachment of the rail 2 to the bracket. The biasing of the finger 53 can be provided via resiliency of the material of the finger (e.g. material property of the material that composes the finger) and/or is integrated structure within the profile 51 and/or attachment to the bracket for positioning within the top profile 51 of the bracket.

For instance, in some embodiments, a spring (e.g. a torsion spring) may be coupled to an axle to which the finger 53 is attached and/or the finger 53 adjacent the top profile 51 of the bracket for providing the biasing force that acts on the finger 53. In other embodiments, the resilient property of the material composition of the finger in connection with its connection and/or integration into the top profile 51 of the bracket can provide the biasing force. For example, the finger 53 can be defined within a body of the bracket to be part of the top profile 51 and can be composed of a polymeric material or an elastomeric material that provides the resiliency of the finger needed to facilitate bending or flexing in response to the rail sliding over the finger and the finger moving upwardly through the locating hole 2*f* once that hole is aligned with the finger 53. For such embodiments, the entirety of the bracket body may be composed of the polymeric material or just the top portion of the bracket may be composed of this material and may be attached via over molding, fasteners, bonding, welding, or other type of attachment mechanism to another portion of the body of the bracket. In yet other embodiments, the finger 53 may be attached to a biasing mechanism positioned on the bracket or attached to the bracket such that the finger extends upwardly above the top of the bracket's top profile 53 for resiliently moving below a rail when the rail is slide over the finger 53 and subsequently moving into the locating hole 2*e* via the biasing force provided by the biasing mechanism (e.g. a spring, a torsion spring, a coil spring, etc.) in response to the locating hole 2*e* in the rail 2 being aligned with the finger 53 as the rail is slid along the top of the rail via first and second grooves 55 and 57.

After the rail is located on the top profile and interlocked with at least one finger 53 via at least one locating hole 2*e* for attachment of each end of the rail to a respective bracket's top profile 51, the rail and bracket can be fastened adjacent a window (e.g. to a portion of a window frame such as a head jamb or side jamb of a window frame etc. or to structure located adjacent a window frame such as a part of a wall above a window opening or adjacent a side of a window opening or the head jamb or a side jamb of a window frame). The rail and bracket can be fastened to that structure via fasteners passed through holes of the bracket and rail that are aligned with each other when the one or more fingers 53 are interlocked within the locating hole(s) 2*e* of the top profiles 51 of the first and second brackets. For example, screws or bolts can be passed through holes in the top of the bracket that are aligned with first and second installation holes 2*f* and 2*g* defined adjacent the first and second ends 2*a* and 2*b* of the rail that are positioned between the more distally located locating holes 2*e*.

Figure 9:
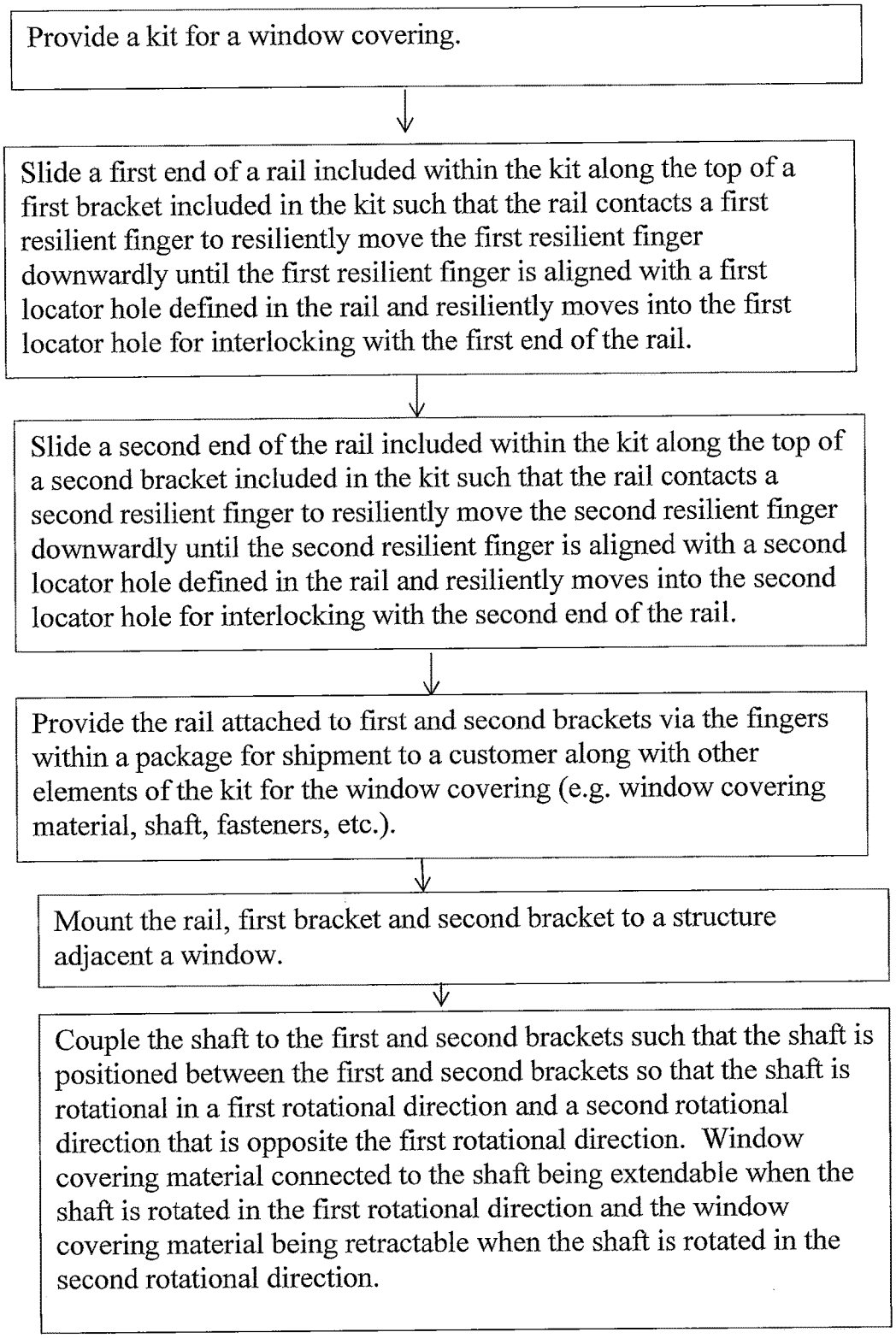
FIG. 9 is a flow chart illustrating an exemplary method of fabricating and/or installing a window covering.

As can be appreciated from FIG. 9, methods for installing an embodiment of my window covering and/or fabricating an embodiment of my window covering can include the use of the rail 2 and top profiles 51 of the first and second brackets 3 and 5 for forming the window covering and installing the window covering adjacent a window to cover the window can also be appreciated from the disclosure provided herein. For example, a user may receive components of the window covering and instructions for the installation of the window covering as a kit that is provided in the same shipment or box from a seller of window coverings (e.g. retailer, fabricator, etc.). The instructions can help describe a process by which the window covering can be formed and/or installed adjacent a window via use of the components of the kit provided to the customer. The components in the shipment can include the first and second brackets 3 and 5, the rail 2, the shaft 11 having window covering material 13 wrapped about the shaft 11, the shaft end connectors (either already attached to the ends of the shaft or separated for the user to attach to the ends to the shaft), the window covering material position control mechanism 7 connected to the first bracket 3, and the rotatable shaft connection mechanism 9 connected to the second bracket. The user may empty the box of its contents and subsequently insert the first end 2*a* of the rail so that its first and second sides 2*c* and 2*d* fit within first and second grooves 55 and 57 of the top profile 51 of the first rail 3 and subsequently slide the first end 2*a* of the rail 2 along the top of the first bracket 3 while the first and second sides 2*c* and 2*d* slide within the first and second grooves 55 and 57 so that the finger 53 resiliently moves downward due to the rail 2 contacting the finger until the finger 53 is aligned with the locating hole 2*e* and resiliently extends through that locating hole to interlock with the rail 2 within the locating hole 2*e* adjacent the first end 2*a* of the rail 2. The user may then take the second end 2*b* of the rail 2 and insert the second end 2*b* of the rail 2 so that its first and second sides 2*c* and 2*d* fit within first and second grooves 55 and 57 of the top profile 51 of the second rail 5 and subsequently slide the second end 2*b* of the rail 2 along the top of the second bracket 5 while the first and second sides 2*c* and 2*d* slide within the first and second grooves 55 and 57 so that the finger 53 resiliently moves downward due to the rail 2 contacting the finger 53 until the finger 53 is aligned with the locating hole 2*e* and resiliently extends through that locating hole 2*e* to interlock with the rail 2 within the locating hole 2*e* adjacent the second end 2*b* of the rail 2. After the first and second brackets 3 and 5 are attached to the rail 2 via their top profiles 51 and resilient fingers 53, the brackets may be positioned adjacent a window opening and fasteners can be passed through attachment holes in the rail and brackets that are aligned with each other such as holes 2*f* and 2*g* adjacent the first and second ends of the rail 2 between the locating holes 2*e* that are adjacent the distal first and second ends 2*a* and 2*b* of the rail 2 and holes in the brackets aligned with these holes for mounting of the rail 2 and first and second brackets 3 and 5.

In yet other embodiments of the method, such as the embodiment shown in FIG. 9, the rail 2 can be coupled to the first and second brackets 3 and 5 via the first and second grooves 55 and 57, resilient fingers 53, and locating holes 2*e* by a manufacturer prior to putting the coupled brackets and rail within a package for shipment of a product to a customer (e.g. a retailer or other purchaser). The package may include other elements of a kit for the window covering such as the shaft 11, window covering material 13 wound on the shaft, and fasteners for mounting of the window covering 1. The window covering material position control mechanism 7 can be pre-attached to the first bracket 3 and the second bracket 5 can also have a shaft connection mechanism 9 or other type of device (e.g. a second window covering material position control mechanism) pre-attached thereto prior to the rail 2 being coupled to the brackets via the first and second grooves 55, 57 and fingers 53. Such an arrangement can permit an end customer to open the package and use fasteners to mount the rail 2 and first and second brackets 3 and 5 without having to personally attach the brackets to the rail 2 so that the installation of the window covering can occur more quickly and easily.

It should be appreciated that the fingers 53 and profiles 51 of the first and second brackets 3 and 5 interlocking with the rail 2 can help ensure that the spacing of the first and second brackets 3 and 5 is sufficient for the shaft 11 to extend between the brackets and accurately position the window covering material to cover the window while also permitting the window covering material position control mechanism 7 to be effectively coupled to the shaft for controlling positioning of the window covering material. In this regard, the length of the rail 2 can be set by the manufacturer to work in combination with the fingers 53 and the locating holes 2*e* to help ensure that the first and second brackets 3 and 5 are properly spaced apart to facilitate the accurate installation of the window covering in a relatively easy, intuitive way.

After the rail 2 and first and second brackets 3 and 5 are mounted to the window frame or a structure adjacent the window frame above and relatively adjacent to a window, the shaft 11 can be connected between the first and second brackets 3 and 5. For instance, after the rail and brackets are mounted, the user may then couple the shaft 11 having the window covering material 13 wound thereon to the first and second brackets 3 and 5 to complete the installation of the window covering. For instance, the first end 11*a* of the shaft can be connected to the window covering material position control mechanism 7 that is connected to the first bracket 3 and the second bracket 5 can be connected to a second end 11*b* of the rotatable shaft 11 that is opposite the first end of the rotatable shaft 11 via the rotatable shaft connection mechanism 9 attached to the second bracket 5 (or a second the window covering material position control mechanism 7 that may be coupled to the second bracket 5). For example, a user or installer may insert the projection 17 of the first end shaft connector 18 connected to the first end 11*a* of the shaft 11 so that the projection 17 passes through hole 7*e* in housing 7*d* to interlockingly mate within a central opening in a spring motor pulley of the window covering material position control mechanism 7 coupled to the first bracket 3 and may thereafter move the shaft to insert projection 23 of the second end shaft connector 22 into aperture 42 of the rotatable shaft connection mechanism for being retained in the aperture 42 for coupling the second end 11*b* of the rotatable shaft 11 to the second bracket 5. The window covering material 13 can be pre-coupled and pre-wrapped about the shaft 11, which may also have the first end shaft connector 18 and second end shaft connector 22 attached to the first and second ends of the shaft so that an installer need not have to position or attach those connectors or the window covering material 13. This way, once the shaft 11 is coupled to the first and second brackets, the shaft 11 is operatively connected to an element of the window covering material position control mechanism 7 so that the window covering material can be moved to a desired position and maintained in that position. Thereafter, the window covering material 13 can be manipulated by a user of the installed window covering 1 to change the position of the window covering material between fully retracted (e.g. fully wrapped about shaft 11 or fully raised position of the window covering material 13) and fully extended positions (e.g. fully unwound from shaft or fully lowered position).

Of course, in alternative embodiments the first end shaft connector 18 and second end shaft connector 22 could be separate elements within a kit or box that is sent to a customer or bought by a customer that need to be attached to the shaft 11 prior to coupling the shaft 11 to the brackets. Similarly, the window covering material 13 could be a separate element within the kit or box and need to be coupled to the shaft 11 prior to or after attachment of the shaft 11 to the first and second brackets 3 and 5 via the first end shaft connector 18 and second end shaft connector 22.

It should be understood that different embodiments of my window covering may include different elements to meet different sets of design criteria. For instance, the window covering material position control mechanism 7 can be configured as a loop cord drive that has a looped cord operator cord instead of utilizing a spring motor unit or may utilize a roller spring positioned within the shaft 11 instead of the spring motor unit or use of a looped cord drive. In yet other embodiments, the window covering may utilize yet another type of window covering material position control mechanism. As another example, the window covering material 11 can be configured to extend or retract from the rotatable shaft 11 or from adjacent the rotatable shaft 11 without being wound and unwound from that shaft 11 via the use of lift cords and/or pulleys that are connected to the shaft 11. As yet another example, the window covering material can be composed of fabric, a film, woven wood, woven bamboo, be another type of window covering material. As yet another example, some embodiments of the window covering may not utilize a rail 2 that extends between the first and second brackets 3 and 5. Yet other embodiments of the window covering may utilize a U-shaped member instead of a flat, linearly extending rail such that front and rear sidewalls of the U-shaped member extend below the top of the rail to cover the shaft 11 or house the shaft 11 within a channel defined by the U-shaped member. As yet another example, the end shaft connections between the first and second ends of the shaft 11 and the first and second brackets 3 and 5 can be configured so that a projection extends from an element connected to the bracket for receipt within an aperture of a connector attached to the end of the shaft 11 or so that a projection extending from the end of a shaft is received within a hole or other type of aperture of a structure attached to the bracket. Each end of the shaft may have a similar connection mechanism to its respective bracket or may have a different connection mechanism utilized for its connection to its respective bracket. Thus, while certain exemplary embodiments of window covering 1, window covering material position control mechanism 7, improved stability and installation mechanism, and methods of making and using the same have been shown and described above, it is to be distinctly understood that the invention is not limited thereto but may be otherwise variously embodied and practiced within the scope of the following claims.

What is claimed is:

1. A window covering comprising:

a shaft having a first end and a second end opposite the first end;

window covering material connected to the shaft;

a first bracket;

a second bracket spaced apart from the first bracket;

a window covering material position control mechanism connected to the first bracket, the window covering material position control mechanism comprising a first spring motor pulley above a second spring motor pulley and a spring extending from the first spring motor pulley to the second spring motor pulley, wherein the first spring motor pulley has a hole;

the second end of the shaft connected to the second bracket such that the shaft is rotatable in a first rotational direction for extending the window covering material and is rotatable in a second rotational direction opposite the first rotational direction for retracting the window covering material; and the first end of the shaft connected to the first spring motor pulley such that the shaft is rotatable in the first rotational direction and is also rotatable in the second rotational direction and such that the spring biases the shaft to rotate in the second rotational direction for retracting the window covering material; and a first end shaft connector connected to the first end of the shaft, the first end shaft connector having a projection that extends into the hole of the first spring motor pulley via a hole in a housing attached to the first bracket that encloses the first and second spring motor pulleys within the first bracket for coupling the first end of the shaft to the first spring motor pulley.

2. The window covering of claim 1, a second end shaft connector connected to the second end of the shaft, the second end shaft connector having a projection that extends into an aperture of a rotatable shaft connection mechanism attached to the second bracket for connecting the second end of the shaft to the second bracket.

3. The window covering of claim 2, wherein at least one of:

the projection of the second end shaft connector is extendable into and out of a body of the second end shaft connector; and the projection of the first end shaft connector is extendable into and out of a body of the first end shaft connector.

4. The window covering of claim 1, comprising:

a rail extending between the first bracket and the second bracket above the shaft.

5. The window covering of claim 4, wherein:

a top of the first bracket has a first resilient finger; and the rail has a first end having a first locator hole, the first resilient finger being resiliently interlocked within the first locator hole such that the first resilient finger is configured to resiliently move downwardly in response to contact from the rail when the rail is slid along the top of the first bracket and subsequently resiliently moves into the first locator hole when the first locator hole is aligned with the first resilient finger.

6. A window covering comprising:

a shaft having a first end and a second end opposite the first end;

window covering material connected to the shaft;

a first bracket;

a second bracket spaced apart from the first bracket;

a window covering material position control mechanism connected to the first bracket, the window covering material position control mechanism comprising a first spring motor pulley above a second spring motor pulley and a spring extending from the first spring motor pulley to the second spring motor pulley;

the second end of the shaft connected to the second bracket such that the shaft is rotatable in a first rotational direction for extending the window covering material and is rotatable in a second rotational direction opposite the first rotational direction for retracting the window covering material; and the first end of the shaft connected to the first spring motor pulley such that the shaft is rotatable in the first rotational direction and is also rotatable in the second rotational direction and such that the spring biases the shaft to rotate in the second rotational direction for retracting the window covering material; and wherein the first spring motor pulley has a hole and the first end of the shaft is connected to a first end shaft connector, the first end shaft connector having a projection that extends into the hole of the first spring motor pulley to connect the first end of the shaft to the first spring motor pulley.

7. The window covering of claim 6, comprising:

a second end shaft connector connected to the second end of the shaft, the second end shaft connector having a projection that extends into an aperture of a rotatable shaft connection mechanism attached to the second bracket for connecting the second end of the shaft to the second bracket.

8. The window covering of claim 7, wherein at least one of:

the projection of the second end shaft connector is extendable into and out of a body of the second end shaft connector; and the projection of the first end shaft connector is extendable into and out of a body of the first end shaft connector.

9. The window covering of claim 7, comprising:

a rail extending between the first bracket and the second bracket above the shaft; and wherein:

a top of the first bracket has a first resilient finger;

a top of the second bracket has a second resilient finger;

the rail has a first end having a first locator hole and a second end opposite the first end of the rail, the second end of the rail having a second locator hole; and wherein the first resilient finger is interlocked within the first locator hole and the second resilient finger is interlocked within the second locator hole.

10. The window covering of claim 9, wherein:

the first resilient finger is configured to resiliently move downwardly in response to contact from the rail when the rail is slid along the top of the first bracket and subsequently resiliently moves into the first locator hole when the first locator hole is aligned with the first resilient finger; and the second resilient finger is configured to resiliently move downwardly in response to contact from the rail when the rail is slid along the top of the second bracket and subsequently resiliently moves into the second locator hole when the second locator hole is aligned with the second resilient finger.

11. The window covering of claim 10, wherein:

the top of the first bracket has a profile that defines a first groove and a second groove, the first resilient finger being positioned between the first groove and the second groove of the top of the first bracket;

the top of the second bracket has a profile that defines a first groove and a second groove, the second resilient finger being positioned between the first groove of the top of the second bracket and the second groove of the top of the second bracket; and wherein the rail has a first side and a second side, the first side of the rail having a profile configured to fit within and slide along the first groove of the top of the first bracket and the first groove of the top of the second bracket, the second side of the rail having a profile configured to fit within and slide along the second groove of the top of the first bracket and the second groove of the top of the second bracket.

12. The window covering of claim 6, comprising:

a rail extending between the first bracket and the second bracket above the shaft.

13. The window covering of claim 12, wherein:

a top of the first bracket has a first resilient finger; and the rail has a first end having a first locator hole, the first resilient finger being resiliently interlocked within the first locator hole.

14. The window covering of claim 13, wherein:

a top of the second bracket has a second resilient finger;

the rail has a second end opposite the first end, the second end having a second locator hole, the second resilient finger being resiliently interlocked within the second locator hole.

15. A window covering comprising:

a shaft having a first end and a second end opposite the first end;

window covering material connected to the shaft;

a first bracket;

a second bracket spaced apart from the first bracket;

a window covering material position control mechanism connected to the first bracket, the window covering material position control mechanism comprising a first spring motor pulley above a second spring motor pulley and a spring extending from the first spring motor pulley to the second spring motor pulley;

the second end of the shaft connected to the second bracket such that the shaft is rotatable in a first rotational direction for extending the window covering material and is rotatable in a second rotational direction opposite the first rotational direction for retracting the window covering material; and the first end of the shaft connected to the first spring motor pulley or the second spring motor pulley such that the shaft is rotatable in the first rotational direction and is also rotatable in the second rotational direction and such that the spring biases the shaft to rotate in the second rotational direction for retracting the window covering material;

a rail extending between the first bracket and the second bracket above the shaft;

a top of the first bracket having a first resilient finger; and the rail having a first end having a first locator hole, the first resilient finger being resiliently interlocked within the first locator hole, the top of the first bracket has a profile that defines a first groove and a second groove, the first resilient finger being positioned between the first groove and the second groove of the top of the first bracket; and the rail has a first side and a second side, the first side of the rail having a profile configured to fit within and slide along a first groove of the top of the first bracket and the second side of the rail having a profile configured to fit within and slide along the second groove of the top of the first bracket.

16. The window covering of claim 15, wherein:

a top of the second bracket has a second resilient finger;

the rail has a second end opposite the first end, the second end having a second locator hole, the second resilient finger being interlocked within the second locator hole;

the top of the second bracket has a profile that defines a first groove and a second groove, the second resilient finger being positioned between the first groove of the top of the second bracket and the second groove of the top of the second bracket; and the first side of the rail having a profile configured to fit within and slide along a first groove of the top of the second bracket and the second side of the rail having a profile configured to fit within and slide along the second groove of the top of the second bracket.

17. A window covering comprising:

a shaft having a first end and a second end opposite the first end;

window covering material connected to the shaft;

a first bracket;

a second bracket spaced apart from the first bracket;

a window covering material position control mechanism connected to the first bracket, the window covering material position control mechanism comprising a first spring motor pulley above a second spring motor pulley and a spring extending from the first spring motor pulley to the second spring motor pulley;

the second end of the shaft connected to the second bracket such that the shaft is rotatable in a first rotational direction for extending the window covering material and is rotatable in a second rotational direction opposite the first rotational direction for retracting the window covering material; and the first end of the shaft connected to the first spring motor pulley or the second spring motor pulley such that the shaft is rotatable in the first rotational direction and is also rotatable in the second rotational direction and such that the spring biases the shaft to rotate in the second rotational direction for retracting the window covering material;

a rail extending between the first bracket and the second bracket above the shaft;

a top of the first bracket having a first resilient finger; and the rail having a first end having a first locator hole, the first resilient finger being resiliently interlocked within the first locator hole, the first resilient finger is configured to resiliently move downwardly in response to contact from the rail when the rail is slid along the top of the first bracket and subsequently resiliently moves into the first locator hole when the first locator hole is aligned with the first resilient finger;

a top of the second bracket having a second resilient finger;

the rail having a second end opposite the first end, the second end having a second locator hole, the second resilient finger being resiliently interlocked within the second locator hole, the second resilient finger is configured to resiliently move downwardly in response to contact from the rail when the rail is slid along the top of the second bracket and subsequently resiliently moves into the second locator hole when the second locator hole is aligned with the second resilient finger.

18. The window covering of claim 17, wherein:

the top of the first bracket has a profile that defines a first groove and a second groove, the first resilient finger being positioned between the first groove and the second groove of the top of the first bracket; and the top of the second bracket has a profile that defines a first groove and a second groove, the second resilient finger being positioned between the first groove of the top of the second bracket and the second groove of the top of the second bracket.

19. A window covering comprising:

a first bracket, a top of the first bracket having a first resilient finger;

a second bracket spaced apart from the first bracket, a top of the second bracket having a second resilient finger;

a shaft positioned between the first bracket and the second bracket that is rotatable in a first rotational direction and a second rotational direction that is opposite the first rotational direction;

window covering material connected to the shaft that is extendable when the shaft rotates in the first rotational direction and is retractable when the shaft rotates in the second rotational direction; and a rail extending from the first bracket to the second bracket, the rail being positioned above the shaft, the rail having a first end and a second end, the first end of the rail having a first locator hole and the second end of the rail having a second locator hole; and wherein the first resilient finger is resiliently interlocked within the first locator hole and the second resilient finger is resiliently interlocked within the second locator hole, the first resilient finger is configured to resiliently move downwardly in response to contact from the rail when the rail is slid along the top of the first bracket and subsequently resiliently moves into the first locator hole when the first locator hole is aligned with the first resilient finger; and the second resilient finger is configured to resiliently move downwardly in response to contact from the rail when the rail is slid along the top of the second bracket and subsequently resiliently moves into the second locator hole when the second locator hole is aligned with the second resilient finger.

20. The window covering of claim 19, wherein:

the top of the first bracket has a profile that defines a first groove and a second groove, the first resilient finger being positioned between the first groove and the second groove of the top of the first bracket;

the top of the second bracket has a profile that defines a first groove and a second groove, the second resilient finger being positioned between the first groove of the top of the second bracket and the second groove of the top of the second bracket; and the rail has a first side and a second side, the first side of the rail having a profile configured to fit within and slide along the first groove of the top of the first bracket and the first groove of the top of the second bracket, the second side of the rail having a profile configured to fit within and slide along the second groove of the top of the first bracket and the second groove of the top of the second bracket.

* * * * *